US007060199B2

(12) United States Patent
Woydt et al.

(10) Patent No.: US 7,060,199 B2
(45) Date of Patent: Jun. 13, 2006

(54) BIODEGRADABLE FUNCTIONAL FLUID FOR MECHANICAL DRIVES

(75) Inventors: Mathias Woydt, Berlin (DE); Michael Hötger, Berlin (DE); Jens Kleemann, Berlin (DE)

(73) Assignee: TEA GmbH Technnologiezentrum, Emissionsfreie Antriebe, Berlin (DE)

( * ) Notice: Subject to any disclaimer, the term of this patent is extended or adjusted under 35 U.S.C. 154(b) by 0 days.

(21) Appl. No.: 11/019,429

(22) Filed: Dec. 22, 2004

(65) Prior Publication Data

US 2005/0143264 A1 Jun. 30, 2005

Related U.S. Application Data

(62) Division of application No. 10/380,032, filed as application No. PCT/DE01/03672 on Sep. 20, 2001, now Pat. No. 6,913,707.

(30) Foreign Application Priority Data

Sep. 22, 2000 (DE) ..... 100 49 175

(51) Int. Cl.
*C09K 5/00* (2006.01)
*C10M 169/00* (2006.01)

(52) U.S. Cl. ..... 252/71; 252/73; 252/77; 252/79; 508/459; 508/506; 508/508

(58) Field of Classification Search ..... None
See application file for complete search history.

(56) References Cited

U.S. PATENT DOCUMENTS

| | | | | |
|---|---|---|---|---|
| 3,992,312 A | | 11/1976 | Genjida et al. | |
| 4,855,070 A | | 8/1989 | Lewis et al. | |
| 5,401,428 A | * | 3/1995 | Kalota et al. | 508/508 |
| 5,616,544 A | | 4/1997 | Kalota et al. | |
| 5,876,623 A | | 3/1999 | Tang et al. | |
| 5,942,150 A | * | 8/1999 | Heuer et al. | 252/70 |
| 6,022,401 A | | 2/2000 | Tang et al. | |
| 6,194,359 B1 | | 2/2001 | Beyer et al. | |

FOREIGN PATENT DOCUMENTS

| | | | |
|---|---|---|---|
| DE | 43 11 237 | | 10/1994 |
| DE | 196 47 554 | | 5/1998 |
| EP | 0 464 491 | | 1/1992 |
| EP | 0 596 197 | | 6/1993 |
| EP | 0596197 | * | 6/1993 |
| JP | 52 096876 | | 6/1977 |
| WO | WO95/16767 | | 6/1995 |
| WO | WO97/04052 | | 2/1997 |

* cited by examiner

*Primary Examiner*—Yogendra Gupta
*Assistant Examiner*—Amina Khan
(74) *Attorney, Agent, or Firm*—Collard & Roe, P.C.

(57) ABSTRACT

The invention relates to a water-based biodegradable and non-toxic functional fluid for mechanical drives, preferably for use in steam engines. The object of providing such functional fluids for use in mechanical drives, particularly for the hydrodynamic lubrication of plain bearings, preferably for crankshafts of superheated steam engines, having customary bearing play which is not overly precise, is achieved. It should be capable of being used in closed power plant systems also at sump temperatures higher than 120° C., e.g. in the crankcase under a crank shaft, and should be water-based or water-dilutable. According to the invention, this is achieved by addition of a low percentage of polyaspartic acid to water or to water/glycol mixtures, preferably polyaspartic acid having a molar mass of from greater than 1 000 to 10 000 g/mol being used.

7 Claims, No Drawings

BIODEGRADABLE FUNCTIONAL FLUID FOR MECHANICAL DRIVES

CROSS REFERENCE TO RELATED APPLICATIONS

This application is a divisional and claims priority under 35 U.S.C. § 120 and 35 U.S.C. § 121 of U.S. patent application Ser. No. 10/380,032 filed on Mar. 10, 2003 now U.S. Pat. No. 6,913,707. Applicants claim priority under 35 U.S.C. §119 of German Application No. 100 49 175.8 filed on Sep. 22, 2000. Applicants also claim priority under 35 U.S.C. §365 of PCT/DE01/03672 filed on Sep. 20, 2001. The international application under PCT article 21(2) was not published in English.

The present invention relates to a biodegradable and non-toxic functional fluid for mechanical drives, according to the preamble of the main claim and of the subclaims, It is already generally known that glycols and polyglycols can be used for lubrication purposes. Polyglycols have advantageous viscosity-temperature behavior even in the case of high shear rates high stability to shearing and good lubrication behavior as well as antiwear and extreme pressure properties under mixed and boundary friction conditions. Under thermal load, they decompose without leaving a residue only at above 260° C., depending on molecular structure and without additives.

The liquid polyethylene glycols which have a molar mass of 200–400 g/mol and are water-soluble, rapidly biodegradable, physiologically safe and skin-tolerating are preferably used.

In general, it is also already known that synthetic lubricants can be prepared from polyalkylene glycols, from a mixture of ethylene oxide and propylene oxide.

It is already known from the publication DE 196 47 554 A1 (U.S. Pat. No. 6,194,359) that functional fluids for internal combustion engines which are based on the abovementioned substances can be prepared, polyalkylene glycols being mixed with a number of additives, which however account for a very small amount by weight, <5% by weight, of the fluid. These functional fluids are to be used both as a permanent lubricant and as a permanent coolant. Their particular properties are good heat transmission, biodegradability, no content of heavy metals and smokeless and soot-ash-free combustion on entrainment into combustion chambers.

It is already known from the publication U.S. Pat. No. 5,401,428 that water-miscible cooling lubricants for machining processes contain 5–50% by weight of the sodium salt of polyaspartic acid—PAA—and are used in open tribological systems. A reduced coefficient of friction is established with increasing amount of polyaspartic acid.

It is also already known from the publication EP 0 596 197 that esters of aspartic acid, as a corrosion-inhibiting additive, can preferably be mixed with mineral hydraulic oils.

Water/glycol hydraulic fluids which are stable to shearing and comprise from 30 to 40% by weight of water and from 35 to 50% by weight of diethylene glycol, 0.8% –5% of aliphatic carboxylic acids and 1%–4% of alkylmorpholine also being present are already known from the publication U.S. Pat. No. 4,855,070.

This amount of morpholine as a multifunctional additive ensures the extreme pressure and antiwear properties as well as corrosion inhibition properties. In addition, triazoles and thiazoles may be present as corrosion inhibitors.

According to OECD 301B, these fluids are 85% biodegradable but, according to VwVwS-99 (German Water Pollution Act, Allgemeine Verwaltungsvorschrift zum Wasserhaushaltsgesetz über die Einstufung wassergefährdender Stoffe in Wassergefährdungsklassen, dated 17, Mai 1999, published 29, Mai 1999, Bundesanzeiger, Jg. 51, Nummer 98a, ISSN 0720-6100), all additives are assigned to water pollution classes (referred to below as WPC) WPC 1 (slightly hazardous), WPC 2 (hazardous) or WPC 3 (strongly hazardous).

None of the additives used in the functional fluids described above fulfil the toxicological and ecological criteria which are relevant in the future and are required, for example, in the draft of ISO CD15380 or of ASTM D6046-96 or for the German environmental label UZ79 for hydraulic oils as well as the new European Commission directive EC/1999/45, in force by 31, Jul., 2002.

The use of ester-based tocopherols as lubricants for machines in the food industry is already known from the publication EP 0 464 491.

It is the object of the invention to provide biodegradable and nontoxic functional fluids for mechanical drives, which fluids are particularly suitable for the hydrodynamic lubrication of plain bearings, preferably for crankshafts of superheated steam engines, having customary bearing clearance which is not overly precise. These functional fluids should be capable of being used in closed power plant systems also at lubricant sump temperatures higher than 120° C., e.g. in the crankcase under a crank shaft, and should be water-based or be capable of being water-dilutable.

According to the invention, this object is achieved by the compositions described in the characterizing clause of the main claim and the subclaims.

In a first embodiment, water-based functional fluids according to the invention comprise water and added polyaspartic acid.

The polyaspartic acid contained in all stated functional fluids according to the invention preferably has a molar mass greater than 1 000 g/mol, preferably up to 3 400 g/mol or up to 10 000 g/mol. It may preferably be used in the form of both Na-PAA—sodium salt of polyaspartic acid—and $NH_3$-PAA—ammonium salt of polyaspartic acid containing <5% by weight of the functional fluid.

In a second variation, the functional fluid comprises water and polyethylene glycols and/or polyalkylene glycols having a molar mass greater than 1 200 g/mol or comprises amounts of both abovementioned substances with the addition of the stated salts of polyaspartic acid.

In a third variation, functional fluids comprise 1,2-monopropylene glycol, also referred to as 1,2-propanediol, and added polyaspartic acid.

In a fourth variation, functional fluids comprise 1,2-monopropylene glycol and polyethylene glycols or polyalkylene glycols and added polyaspartic acid.

In a fifth variation, functional fluids comprise triethylene glycol and added polyaspartic acid.

In a sixth variation, the functional fluids are water-dilutable and biodegradable, the base fluid comprising polyethylene glycols or polyalkylene glycols having a molar mass of less than 1 000 g/mol or mixtures of these substances, and polyaspartic acid being present.

These functional fluids according to the 2nd to 6th variants have very good extreme pressure properties and in some cases surpass those of engine lubricating oils or of functional fluids intended in the future for lubricating and cooling internal combustion engines.

In a seventh variation, the functional fluids are water-dilutable and biodegradable to a certain extent, the base fluid comprising tocopherol—vitamin E—with addition of an amount of polyaspartic acid having a molar mass of greater than 1 000 to 10 000 g/mol. Functional fluids having such a composition are suitable for application temperatures of less than 100° C. Tocopherols are substances occurring in nature and in the human body.

Properties and Effects of Substances Used

Polyaspartic Acids

Functional fluids according to the invention contain salts of polyaspartic acid, their amount advantageously being <5% by weight. All types of D-, L- and DL-polyaspartic acids are suitable, but preferably L-polyaspartic acid, as a salt of potassium, sodium, lithium or ammonium having a molecular weight of from 1 000 to 10 000 g/mol.

Their use generally results in an increase in the viscosity and in the viscosity index of water or of water contents entrained into a base fluid comprising polyethylene glycols or polyalkylene glycols.

In the absence of polyaspartic acid, there would be a considerable reduction in viscosity due to the unavoidable water entrainment, which is associated with production-related dilution or the blow-by in a steam engine.

Multifunctional properties of polyaspartic acid arise from the fact that it is polar owing to the —[COOH] and [C═O] groups and these groups are absorbed by surfaces in tribological systems. Consequently, these molecules impart anti-wear properties and extreme pressure properties (AW/EP), which lead to a reduction in the mixed/boundary friction under start/stop conditions.

The molecules are strongly anionic and act as a strong regulator or stabilizer having a TBN number of ≈100 mg KOH/g for the PH.

The polyaspartic acid acts as a dispersant and as a corrosion-inhibiting additive and prevents lime deposits. It can be used up to an ambient temperature of 120° C.

Polyaspartic acid is a substance which occurs in nature and is classed as slightly water-polluting (WPC 1) and is in principle biodegradable (>63% OECD301E) or biotically (>77% OECD302B) degradable.

Polyethylene Glycols

The polyethylene glycols which can be used according to the invention [CAS: 8038-37-7; CAS: 9002-90-8; CAS: 25322-58-3]have a molar mass greater than 200 g/mol and preferably up to 3 500 g/mol. The solubility of waxy polyethylene glycol having a molar mass of 3 500 g/mol is, for example, 56% in water at 20° C.

In an inert atmosphere, polyethylene glycols decompose above 250° C. without leaving a residue or ash. This is important for use in a steam engine because blow-by of polyethylene glycols into the steam circulation can scarcely be ruled out but has no consequences.

Owing to their water solubility, polyethylene glycols are classed as slightly water-polluting (WPC 1) and should be classed as toxicological only in large amounts. The biodegradability (OECD 301B) is >85% for molar masses of less than 10,000 g/mol. They are US-FDA approved.

Triethylene Glycol

According to the invention, this glycol form [CAS: 112-27-6] can also be used. Owing to the water solubility, its low toxicity and the slow biodegradation —>95% after 14 days—it is classed as slightly water-polluting (WPC 1) and can be safely used.

Polyalkylene Glycols

The butanol-initiated polyalkylene glycols, also referred to as diols, are polymeric blends of ethylene oxide and propylene oxide, which are suitable and can be used in any desired amounts in the ratio from 1:9 to 9:1.

Owing to their water solubility, they are classed as slightly water-polluting (WPC 1). The toxicity of the PAGs is lower than that of glycerol. They are also particularly suitable for superheated steam engines since a lubricant for their crankshafts must be able to absorb up to 50% of water as a consequence of unavoidable "blow-by amounts" in the cylinder units.

Under such conditions, water-immiscible base oils and lubricants cannot be used as polypropylene glycol.

Furthermore, the viscosity properties and lubrication properties of the functional fluids according to the invention permit the use of state of the art material pairs and constructions, e.g. AlSn2O for plain bearing surfaces and tempering steels for the crankshaft, in engine construction.

They conform to a temperature range of −30 to +150° C., which has to be taken into account in the operation of steam engines.

All components of the functional fluids according to the invention decompose at high steam temperatures, which may be permanently up to 600° C. in the steam circulation and even higher in the working area, only into gaseous and/or water-soluble reaction products.

This is decisive because entrainment of the lubricating medium via the cylinder piston gap and the working area into the steam circulation inevitably occurs in customary piston machines.

The abovementioned temperatures are above the flash-points (flashpoint according to ASTM D-92) of from 200 to 250° C. of customary lubricants based on hydrocarbons, e.g. mineral oils or poly-alpha-olefin oils, whereby there would a danger of fire in the case of a leak.

The composition according to the invention, being water-based functional fluid, ensures antifreezing properties down to −30° C.

At a temperature of use of less than 100° C., tocopherols (vitamin E) are suitable as a basis for biodegradable functional fluids according to the invention for mechanical drives with the addition of an amount of polyaspartic acid having a molar mass of from greater than 1 000 to 10 000 g/mol.

Tocopherols

[CAS: α=59-02-9; CAS: β=148-03-8; CAS: γ=7616-22-0; CAS: δ=119-13-1] are substances which occur in nature and in the human body, β- γ- and δ-tocopherols being more thermally stable than α-tocopherol. All forms act as antihydrolysis agents, antioxidants and dispersants and have a certain regeneration capacity. Tocopherols are classed in WPC 1 and are approved by the US FDA for medicament formulations, although they have a biodegradability of only from 4% to 40%.

Functional fluids according to the invention can also be used in underground mining, for engine lubrication and in the food industry and pharmaceuticals industry.

TABLE 1

Extreme pressure properties according to DIN 51350-2 (4-ball-test) similar to ASTM of functional fluids according to the invention

| Composition | Welding force in four ball tester [N] |
|---|---|
| Demineralized water | 600–800 |
| +1% of Na-PAA | 800–1 000 |
| +3% of Na-PAA | 1 600–1 800 |
| +3% of $NH_3$-PAA | 1 000–1 200 |
| +3% of $NH_3$-PAA | 1 400–1 600 |
| 55% of PEG 3 350 g/mol + 45% of demineralized water | 1 200–1 400 |
| +1% of Na-PAA | 1 400–1 600 |
| +3% of Na-PAA | 1 800–2 000 |
| +1% of $NH_3$-PAA | 1 200–1 400 |
| +3% of $NH_3$-PAA | 1 600–1 800 |
| 100% of 1,2-monopropylene glycol | 800–1 000 |

TABLE 1-continued

| Extreme pressure properties according to DIN 51350-2 (4-ball-test) similar to ASTM of functional fluids according to the invention | |
|---|---|
| Composition | Welding force in four ball tester [N] |
| +1% of Na-PAA | 2 000–2 200 |
| +3% of Na-PAA | 3 000–3 200 |
| +1% of $NH_3$-PAA | 1 400–1 600 |
| +3% of $NH_3$-PAA | 1 800–2 000 |
| 100% of triethylene glycol | 1 000–1 200 |
| +1% of Na-PAA | 1 800–2 000 |
| +3% of Na-PAA | 2 600–2 800 |
| +1% of $NH_3$-PAA | 1 400–1 600 |
| +3% of $NH_3$-PAA | >2 800 |
| 100% of PEG 400 g/mol | 1 200–1 400 |
| +1% of Na-PAA | 1 800–2 000 |
| +3% of Na-PAA | 2 400–2 600 |
| +1% of $NH_3$-PAA | 1 400–1 600 |
| +3% of $NH_3$-PAA | 1 600–1 800 |
| 49.4% of 1,2-monopropylene glycol + 50.6% of PEG 200 g/mol | 1 200–1 400 |
| +1% of Na-PAA | 2 000–2 200 |
| +3% of Na-PAA | 2 200–2 400 |
| +1% of $NH_3$-PAA | 1 400–1 600 |
| +3% of $NH_3$-PAA | 1 800–2 000 |

TABLE 2

| Extreme pressure properties according to DIN 51350-2 of motor oils and of functional fluids according to the publication DE 196 47 554 A1. | |
|---|---|
| Motor oil 15W40 Castrol GTX3 Protec (API SJ/CF, ACEA A2/B2-96, CCMC G4, PD2) | 2 000–2 200 |
| Motor oil 0W30 DEA ULTEC SYN-T | 2 000–2 200 |
| Fragol (100 DE 196 47 554 A 1 CV9.24R) | 1 600–1 800 |

The invention claimed is:

1. A method for lubricating mechanical drives in steam engines, comprising the steps of:

(a) providing a water-based bidegradable functional fluid comprising an additive of polyaspartic acid and over 50 weight-% polyethylene glycol; and (b) adding the biodegradable functional fluid to a crankcase of a mechanical drive of a steam engine.

2. The method as recited in claim 1, wherein the proportion of polyethylene glycol of the biodegradable functional fluid has a molar mass of greater than 200 g/mol.

3. A method for lubricating mechanical drives in steam engines, comprising the steps of:

(a) providing a 1,2-monopropylene glycol-based bidegradable functional fluid comprising an additive of polyaspartic acid; and (b) adding the biodegradable functional fluid to a crankcase of a mechanical drive of a steam engine.

4. A method for lubricating mechanical drives in steam engines, comprising the steps of:

(a) providing a biodegradable functional fluid comprising polyethylene glycols or polyalkylene glycols having a molar mass of less than 3,000 g/mol and mixtures thereof and an additive of polyaspartic acid; and (b) adding the biodegradable functional fluid to a crankcase of a mechanical drive of a steam engine.

5. A method for lubricating mechanical drives in steam engines, comprising the steps of:

(a) providing a water-based bidegradable functional fluid comprising an additive of polyaspartic acid having a molar mass of greater than 1,000 to 10,000 g/mol; and (b) adding the biodegradable functional fluid to a crankcase of a mechanical drive of a steam engine.

6. A method for lubricating mechanical drives in steam engines, comprising the steps of:

(a) providing a water-based bidegradable functional fluid comprising an additive of polyaspartic acid wherein the proportion of polyaspartic acid in the functional fluid is formed by a sodium or ammonium salt of the polyaspartic acid having a molar mass of 3,400–3,700 g/mol; and (b) adding the biodegradable functional fluid to a crankcase of a mechanical drive of a steam engine.

7. A method for lubricating mechanical drives in steam engines, comprising the steps of:

(a) providing a water-based bidegradable functional fluid comprising 1 to 5 wt.-% of polyaspartic acid ; and (b) adding the biodegradable functional fluid to a crankcase of a mechanical drive of a steam engine.

* * * * *

UNITED STATES PATENT AND TRADEMARK OFFICE

CERTIFICATE OF CORRECTION

PATENT NO. : 7,060,199 B2
APPLICATION NO. : 11/019429
DATED : June 13, 2006
INVENTOR(S) : Woydt et al.

It is certified that error appears in the above-identified patent and that said Letters Patent is hereby corrected as shown below:

TITLE PAGE item [73], please change "Technnologiezentrum" to correctly read --Technologiezentrum--.
In Column 5, line 46 (Line 1 of paragraph (a) in Claim 1), please change "bidegradable" to correctly read: --biodegradable--.

In Column 6, lines 8-9 (Lines 2-3 of paragraph (a) in Claim 3), please change "bidegradable" to correctly read: --biodegradable--.
In Column 6, line 23 (Line 1 of paragraph (a) in Claim 5), please change "bidegradable" to correctly read: --biodegradable--.
In Column 6, line 30 (Line 1 of paragraph (a) in Claim 6), please change "bidegradable" to correctly read: --biodegradable--.
In Column 6, line 40 (Line 1 of paragraph (a) in Claim 7), please change "bidegradable" to correctly read: --biodegradable--.

Signed and Sealed this

Sixteenth Day of January, 2007

JON W. DUDAS
*Director of the United States Patent and Trademark Office*